United States Patent [19]

Pagano et al.

[11] 4,044,679

[45] Aug. 30, 1977

[54] LAMINATED ARMOR-PIERCING PROJECTILE

[75] Inventors: Victor H. Pagano, Rochester; Server Tasdemiroglu, Sterling Heights, both of Mich.

[73] Assignee: The United States of America as represented by the Secretary of the Army, Washington, D.C.

[21] Appl. No.: 619,874

[22] Filed: Oct. 6, 1975

[51] Int. Cl.[2] ..... F42B 13/06

[52] U.S. Cl. ..... 102/52; 102/92.4

[58] Field of Search ..... 102/52, 92.3, 92.4

[56] References Cited

U.S. PATENT DOCUMENTS

| | | | |
|---|---|---|---|
| 623,707 | 4/1899 | Dittmar | 102/52 |
| 1,094,395 | 4/1914 | Kampen et al. | 102/92.3 |
| 3,877,380 | 4/1975 | Riparbelli | 102/92.4 |

FOREIGN PATENT DOCUMENTS

| | | | |
|---|---|---|---|
| 1,116,112 | 10/1961 | Germany | 102/92.3 |
| 573,914 | 12/1945 | United Kingdom | 102/52 |

*Primary Examiner*—Verlin R. Pendegrass

*Attorney, Agent, or Firm*—Peter A. Taucher; John E. McRae; Nathan Edelberg

[57] ABSTRACT

A shatter resistant armor-piercing military projectile is disclosed. The construction comprises a plurality of high strength metallic lamellae interconnected with a high ductility alloy selected to provide an impact energy management system capable of maintaining the projectile's structural integrity during adverse operating conditions, such as oblique impact on spaced or solid armor targets.

2 Claims, 4 Drawing Figures

LAMINATED ARMOR-PIERCING PROJECTILE

The invention described herein may be manufactured, used, and licensed by or for the Government for governmental purposes without payment to use of any royalty thereon.

BACKGROUND AND SUMMARY OF THE INVENTION

Conventional armor-piercing military projectiles employ one-piece materials such as hardened steel or encased sub-caliber core materials such as tungsten carbide or the like. Ideally, these conventional projectiles perform their function by acting as a high speed punch to penetrate the target armor. During penetration, the conventional projectile will normally experience cracking and consequent breakup. Against oblique targets the breakup or shattering is greatly accentuated. Consequently, the full penetration capability of the projectile is not realized because the material lacks sufficient resistance to brittle fracture under these conditions. The shock wave phenomenon which assists in the destruction of the target armor in the ideal condition may cause the failure of the projectile in the latter situation. The mechanics of this failure will be discussed later.

One remedy for this failure mode would be to increase the ductility of the projectile so as to provide more shock absorbency. However, the results will again be unsatisfactory, because plastic deformation of the projectile will both dissipate its kinetic energy and also result in a larger frontal area as "mushrooming" occurs, thereby decreasing the ability to penetrate.

Applicants propose a compound projectile to solve these problems. Applicants' projectile includes outer relatively hard laminations intended to readily pierce target armor plate, and an inner relatively tough and ductile core intended to maintain the projectile integrity during its passage through the armor plate. It is understood however, that the core could also be made of laminations, and therefore, the complete projectile could be constructed of laminations.

Other inventors have developed compound projectiles of various designs to counter difficulties arising in other ballistic conditions. Walker U.S. Pat. No. 2,792,618 teaches a dual jacket bullet for hunting which features an inner jacket of mild steel or copper running axially from the trailing edge to the midpoint of the projectile. Walter suggests this construction as a mechanism to facilitate expansion or "mushrooming" of the bullet's unreinforced soft metal ogive while preventing complete disintegration of the projectile. Frost U.S. Pat. No. 2,751,845 discloses a two-piece bullet comprising a soft metal base having a mushroom shaped projection running axially forward from its trailing edge so as to lock the lead slug nose into place, thereby preventing separation of the two components upon impact. Crane and Fox U.S. Pat. No. 57,870 describe an artillery shell composed of non-bonded, concentrically cast, metallurgically identical lamellae, with each successive lamination cast upon the previous layer. Crane and Fox developed this construction because their research indicated that many more shell fragments result from the breakup of a non-bonded laminated projectile than are produced by a homogeneous mass having an identical explosive charge contained in a central cavity. Zaid et al U.S. Pat. No. 3,680,485 disclose a series of like projectiles "nested" together for handling purposes, which separate axially while traveling down the gun barrel and leave the muzzle as a series of discrete projectiles.

The foregoing discussion discloses the significant differences between the applicants' projectile and the related prior art. Neither Walker nor Frost teach the use of continual, axially-running concentric laminations of high-strength materials. Therefore, these earilier designs are unsuitable for armor piercing because their monolithic ogives are subject to the brittle fracture and excessive expansion problems. Similarly, the Crane, Fox, and Zaid structures are not comparable to the applicants' projectile in either structure or function. None of the prior art inventors contemplated the use of their teachings to defeat ballistic armor, and this fact is evidenced in the unsuitability of their projectiles for this purpose.

THE PRESENT INVENTION

The applicants' invention provides a solution to the brittle fracture problem encountered by conventional homogeneous, solid-shot, armor-piercing munitions.

Figure 1:
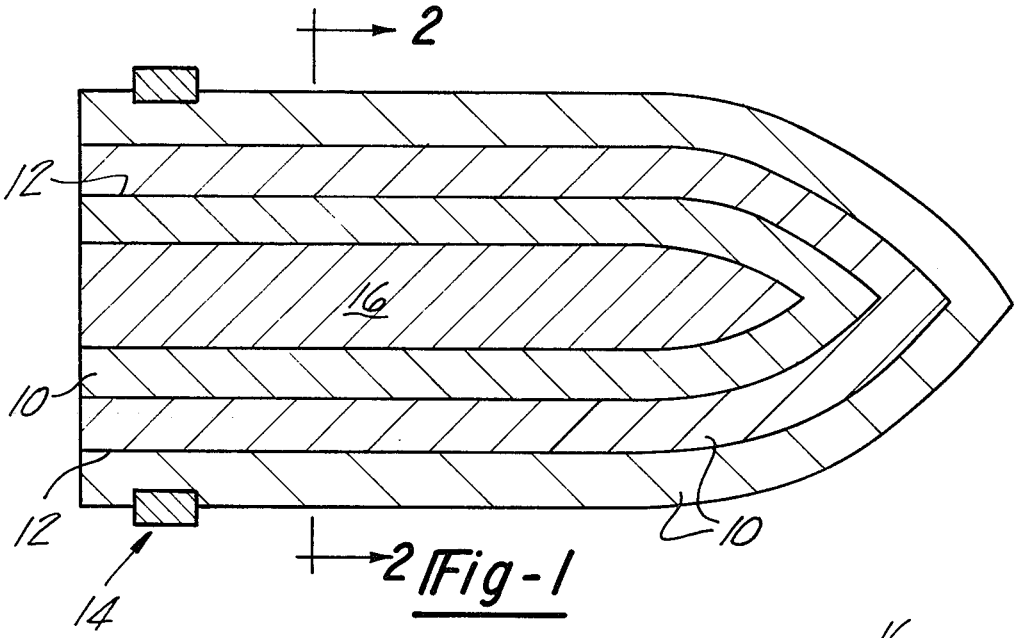
FIG. 1 illustrates a typical cross section of a solid shot armor piercing projectile embodying the instant invention.
Figure 2:
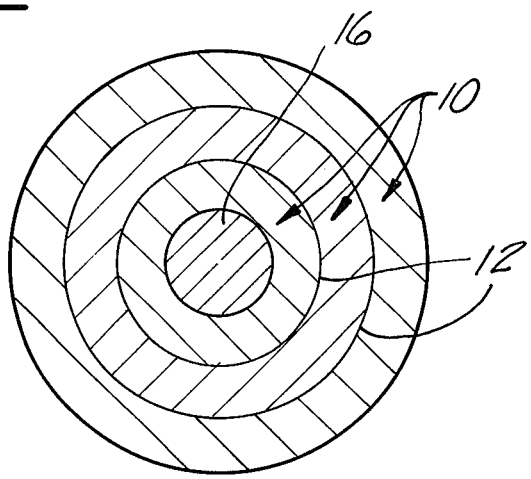
FIG. 2 is a fragmentary sectional view on line 2—2 in FIG. 1.

FIG. 1 shows a projectile comprised of three annular lamellae 10 nested within one another, and a solid core 16. Each high-strength lamella 10 is preferably bonded to its nearest neighbors by a tough metallic brazing material 12 such as copper. In the preferred embodiment, the lamellae are nested closely together to provide a lamellae surface spacing of about 0.001 inch; the corresponding braze material thickness is therefore not visible in FIGS. 1 and 2. Conventional seal ring 14 prevents the propellant gases from leaking past the projectile. Core 16 occupies the central cavity formed by lamellae 10, and may be of lead, tungsten carbide, or any other suitable material, including a continuation of the inner lamellae. It is understood that the impact performance characteristics may be varied by changing the number, thickness, and metallurgical properties of the lamellae. For this reason, the individual lamellae thickness have not been specified. However, the overall outside diameter of the projectile will in one case be in the vicinity of 100 millimeters.

An approximate method for calculating optimum lamellae thickness is through the use of the fracture mechanics definition for a plane strain section thickness:

$$B = 2.5\left(\frac{K_{IC}}{\sigma ys}\right)^2$$

where $B$ = thickness
$\sigma ys$ = proposed yield strength lamella material
$K_{IC}$ = estimated plane strain fracture toughness or critical stress intensity factor for lamellae material This definition provides a means for determining that critical section size or thickness for a particular material condition where mechanical constraint (triaxiality) is maximized (plane strain condition) in the presence of cracks or sharp notches. The definition relates the dependence of thickness B on both material strength and toughness. Thus, larger section thicknesses can be used when the base material employed possesses high toughness or low strength. Conversely, thinner sections must be used when low toughness or high strength material (steel) is employed. In other words, the harder and less ductile the material, the thinner the section thickness needed to provide some amount of plastic response.

The optimum design of the lamellae for this projectile includes high strength (hardness) layers at the surface with low strength (tough) layers at its center or core. This type of strength or hardness gradient provides maximum surface resistance to deformation and crack resistance on target impact and a resilient backup to support the surface on impact. The decreasing hardness of back-up layers also provides increasing resistance to projectile shattering with the onset of any surface cracking. Thus, such a configuration should achieve a maximum degree of penetration effectiveness for all kinetic energy levels.

The optimal steel compositions and hardness gradient from the inner to outer laminations for best results will be determined during heat treatment. However, the equation above provides a suitable basis for identifying thickness limits consistent with the critical factors of strength and toughness. In addition, further improvement could be realized through the use of newer high performance steels, i.e. ESR (electro slag remelted) which affords higher strengths with good fracture toughness and more uniform properties. The steel composition used for each lamellae will vary in alloy and carbon content (hardenability) to provide the needed fracture resistance and strength in response to the cooling rate developed at each lamellae position during heat treatment.

Based on the fracture mechanics equation previously noted, it has been determined that the maximum thickness for the outer lamellae should be no greater than one-eighth inch. Similarly, the maximum practicable thickness for the inner laminations is one inch. These numbers were developed by placing representative values for $\sigma_{ys}$ and $K_{IC}$ in the fracture mechanics equation.

The total number of lamellae will be a function of the projectile's outside diameter. The maximum allowable thickness for each lamellae will not change with projectile diameter since it will be dependent only on the hardness (strength) and toughness desired at a particular depth. The final array of lamellae thicknesses can be adjusted to best fit the finished diameter requirements.

This design will overcome failure due to brittle fracture for the following reasons. First, should a crack develop in one of the outer lamellae, propagation of the fracture through underlying lamellae will be resisted at the interfaces between successive lamellae becuase it is believed that the presence of a highly ductile, dissimilar metal (the brazing alloy), though relatively thin, presents a discontinuity in the metallic crystal lattice through which a fracture cannot readily pass because the brazing alloy serves to manage or dissipate the crack propagation energy during its own plastic deformation. In this manner potentially self-destructive stress concentrations are avoided. Second, it is believed that projectile failure due to the action of acoustic waves will be prevented. Brittle fracture of conventional solid-shot armor-piercing projectiles during oblique impact occurs when acoustic waves originating at the point of impact radiate back through the projectile to meet and reinforce other waves which have been reflected at the trailing edge of the shot. It is believed that a substantial portion of the projectiles' initial kinetic energy upon impact is transformed by this shock wave mechanism into vibrational energy. The resulting stresses are of very great magnitude and often exceed the strength of the inter-crystalline bonds, causing catastrophic failure of the projectile.

It is believed that the applicants' design will obviate this failure mode in which the same manner as well-known lamination techniques are employed to prevent the failure of armor plates in high impact situations are shown for example in Sheridan U.S. Pat. No. 2,391,353. The applicants' laminated construction provides a series of acoustical discontinuities which are believed to impede the passage of both primary and reflected sound waves, thereby reducing the projectile's vulnerability to shock-induced fracture. These acoustical discontinuities result from the fact that sound waves travel at unlike velocities in different media. The inter-laminar brazing material has divergent acoustical properties from those of the lamellae. Similarly, the lamellae may be given widely ranging acoustical properties by material selection. The resulting combination of materials is highly resistant to resonant excitation because each acoustical wave must continually change its speed as it traverses the projectile, thereby dissipating the vibrational energy.

Note that brittle fracture resistance is achieved without the use of an extremely ductile material. Therefore, the high-hardness lamellae will maintain the projectiles' original frontal profile and hence its ability to penetrate armor reasonably well.

Figure 3:
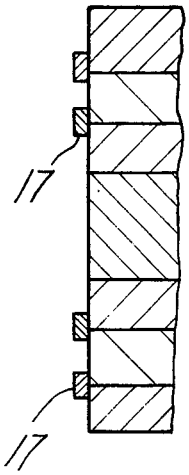
FIG. 3 is a fragmentary sectional view illustrating one method of forming the FIG. 1 projectile.

The applicants' projectile may be fabricated by furnace brazing the various lamellae. The brazing filler metal 12 may be introduced by preplating the lamellae, or by wrapping each lamellae with brazing alloy foil, or, as shown in FIG. 3, by placing (concentric rings) 17 of brazing filler metal in axial juxtaposition with the open annular face so that the molten filler metal will be drawn into the annular voids by capillary action during the brazing process.

Figure 4:
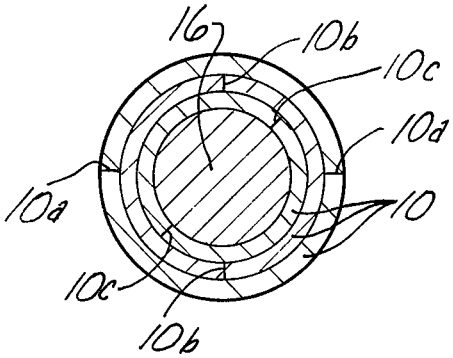
FIG. 4 is a cross section of another embodiment of the invention.

The individual lamellae may be precision cast or formed in one piece by deep drawing; alternatively each lamellae may be precision cast or formed from two semi-annular half sections later joined along the longitudinal parting lines 10*a*, 10*b* or 10*c* of depicted in FIG. 4. Each half section is merely stamped from flat stock having suitable dimensions and metallurgical properties. With the various half sections clamped together within a suitable retainer, the assembly may be placed in a furnace, whereupon the brazing alloy flows into the joints between half sections and also the joints 10a, 10b and 10c, thereby joining the half sections together.

The outer lamellae would preferably be a plain medium carbon or low alloy medium carbon steel such as 10*xx* or 40*xx* steel (0.40–.60% carbon), the inner lamellae of a more hardenable lower carbon content steel such as 43*xx* steel (0.20 –.30% carbon). The brazing compound can be a pure electrolytic copper material. However, the inventors do not wish to restrict themselves to these materials, as other compositions may be utilized by those skilled in the art. Heat treatment to obtain the desired hardness (toughness) gradient throughout the projectile may be accomplished as a sequential part of the furnace brazing process, thereby eliminating a separate heat treat operation. Such heat treatment may comprise a heating zone for braze bonding, then a hardening temperature zone followed by quenching and tempering to achieve a multiple hardening and tempering action for optimizing both hardness and toughness at the various lamellae positions from surface to center.

Another alternative method for effecting the metal bond between lamellae could be the use of hot pressing or forging. In this case, the lamallae assembly would be designed oversize to allow for the necessary amount of metal reduction or flow to effect a metallurgical bond between lamellae.

Appliants believe that their projectile offers the following advantages: First, both strength and ductility are achieved in a single structure. Thus, excessive "mushrooming" and brittle fracture are avoided. Second, because the projectile is nonhomogeneous, the composite metallurgical properties may be varied by the selection of appropriate materials for the different laminations.

The described laminated projectile should be very effective against oblique solid armor targets and especially spaced armor targets. The latter is acknowledged to defeat conventional solid-shot armor-piercing munitions by fracturing the round during its initial impact on the exterior spaced plate, thereby rendering the projectile incapable of piercing the underlying layer(s) of armor. Even though the outer lamellae may possibly crack during impact with the initial target plate material, the inner tougher lamellae and core will maintain the projectile intactness or wholeness through the target to perforate any underlying armor material. The outer relatively hard lamellae is intended to preclude plastic deformation (mushrooming) of the projectile as it impacts the armor target. The inner relatively tough lamellae and core are intended to maintain projectile integrity even though the outer lamellae may crack and/or separate from the projectile during passage through the target material. Thus, no significant loss or change in projectile mass and therefore kinetic energy is suffered.

The materials and thicknesses for the various lamellae may be selected so that successive lamellae after heat treatment are of increasing toughness and decreasing hardness, and measured inwardly from the projectile surface. If desired, the special core material may be omitted. Preferably the projectile is laminated for its entire length to avoid transverse joints that might present manufacturing and stress concentration operational problems. The individual lamellae may be of different thickness. However, it is believed that each lamellae should have a constant thickness along the entire projectile length, especially at the ogive, to avoid conventional solid shot brittle fracture.

We wish it to be understood that we do not desire to be limited to the exact details of construction show and described for obvious modifications will occur to a person skilled in the art.

We claim:

1. An armor-piercing military projectile of the solid type, comprising a central core (16) nested within a plurality of concentric metallic lamellae (10); each of said core and lamellae having an outer circular cylindrical side surface merging into an axial ogive termination at the projectile front end; each lamellae being a hollow annular shell structure having a substantially uniform wall thickness therealong; said lamellae and core terminating at a common transverse plane at the rear end of the projectile; copper bonding material fused to the core and lamellae surfaces along each entire interface; the lamellae being of decreasing hardness and increasing toughness measured from the outermost lamellae to the innermost lamellae; the outermost lamellae being a quenchhardened steel providing a relatively hard outer surface along the entire length of the projectile.

2. The projectile of claim 1 wherein the outermost lamellae is .40 – .60% carbon steel, and inner lamellae are 0.20 – 0.30% carbon steel.

* * * * *